US008607450B2

(12) United States Patent
Cassemeyer et al.

(10) Patent No.: US 8,607,450 B2
(45) Date of Patent: Dec. 17, 2013

(54) METHOD FOR MANUFACTURING A MICROPUMP AND MICROPUMP

(75) Inventors: Julia Cassemeyer, Reutlingen (DE); Michael Stumber, Korntal-Muenchingen (DE); Franz Laermer, Weil der Stadt (DE); Ralf Reichenbach, Esslingen (DE)

(73) Assignee: Robert Bosch GmbH, Stuttgart (DE)

( * ) Notice: Subject to any disclaimer, the term of this patent is extended or adjusted under 35 U.S.C. 154(b) by 434 days.

(21) Appl. No.: 12/811,936

(22) PCT Filed: Dec. 17, 2008

(86) PCT No.: PCT/EP2008/067708

§ 371 (c)(1),
(2), (4) Date: Oct. 13, 2010

(87) PCT Pub. No.: WO2009/087025

PCT Pub. Date: Jul. 16, 2009

(65) Prior Publication Data

US 2011/0034873 A1 Feb. 10, 2011

(30) Foreign Application Priority Data

Jan. 10, 2008 (DE) ..... 10 2008 003 792

(51) Int. Cl.
*B23P 17/00* (2006.01)

(52) U.S. Cl.
USPC ..... 29/888; 977/906

(58) Field of Classification Search
CPC ..... A61M 5/142; A61M 1/00; B23P 17/00
USPC ..... 29/888; 604/131–155; 977/805, 906
See application file for complete search history.

(56) References Cited

U.S. PATENT DOCUMENTS

| | | | | |
|---|---|---|---|---|
| 2002/0119589 | A1* | 8/2002 | Fischer et al. | 438/48 |
| 2004/0179946 | A1* | 9/2004 | Gianchandani et al. | 417/207 |
| 2006/0027523 | A1* | 2/2006 | Van Lintel et al. | 216/2 |
| 2006/0186085 | A1* | 8/2006 | Fuertsch et al. | 216/41 |
| 2007/0066138 | A1* | 3/2007 | Ferrari et al. | 439/607 |
| 2007/0077273 | A1* | 4/2007 | Martin et al. | 424/423 |
| 2008/0154178 | A1* | 6/2008 | Carter et al. | 604/20 |
| 2008/0218934 | A1* | 9/2008 | Langereis et al. | 361/283.1 |
| 2010/0216126 | A1* | 8/2010 | Balachandran et al. | 435/6 |
| 2011/0108473 | A1* | 5/2011 | Friedberger et al. | 210/184 |

(Continued)

FOREIGN PATENT DOCUMENTS

| | | |
|---|---|---|
| DE | 42 39 464 | 5/1994 |
| DE | 694 10 487 | 11/1998 |
| DE | 103 34 240 | 2/2005 |

(Continued)

OTHER PUBLICATIONS

Fraunhofer IZM: "Department Micromechanics, Actuators and Fluidics"; Internet Citation, [Online] XP002348908 Retrieved from the Internet : URL: Munich>[retrieved on Oct. 12, 2005].

*Primary Examiner* — Nicholas Lucchesi
*Assistant Examiner* — Gerald Landry, II
(74) *Attorney, Agent, or Firm* — Kenyon & Kenyon LLP

(57) ABSTRACT

A method for manufacturing a micropump, which may be for the metered delivery of insulin, multiple layers being situated on the front side of a first carrier layer, which has a front side and a rear side, and microfluidic functional elements being formed by structuring at least one of the layers. It is provided that the structuring of the at least one layer for manufacturing all microfluidic functional elements is exclusively performed by front side structuring. Furthermore, a micropump is disclosed.

42 Claims, 8 Drawing Sheets

(56) References Cited

FOREIGN PATENT DOCUMENTS

| | | |
|---|---|---|
| DE | 10 2005 032452 | 1/2007 |
| DE | 10 2005 04248 | 3/2007 |
| DE | 10 2005 052039 | 5/2007 |
| EP | 0 424 087 | 4/1991 |
| EP | 1 396 469 | 3/2004 |

* cited by examiner

METHOD FOR MANUFACTURING A MICROPUMP AND MICROPUMP

FIELD OF THE INVENTION

The present invention relates to a method for manufacturing a micropump.

BACKGROUND INFORMATION

There are micropumps for the controlled and high-precision dispensing of insulin. It is believed that previous micropumps have been plagued, however, by complex manufacturing processes having many nonstandard process steps. The many special process steps according to the previous related art make micropumps of this type costly and lower the manufacturing yields.

In addition, other micropumps are believed to be insufficiently accurate with respect to the dispensed drug quantities. Micropumps for insulin dispensing must operate very accurately with high metering accuracy, however, and without complex sensors for detecting dispensed insulin quantities. Active flow measurement is very problematic in connection with insulin, because the material reacts adversely to elevated temperatures, for example, in connection with so-called hot film sensors for flow measurement.

In addition, the lack of reliability is a serious disadvantage of known micropumps: thus, for example, in micropumps according to the related art, the dispensed insulin quantity is a function of the initial pressure in the insulin supply container, which may be placed under pressure mechanically if it is designed as a flexible bag. For example, placing or laying the pump carrier on the insulin micropump may cause the supply container to unintentionally dispense insulin, or may result in an unintentional increase in the dose just dispensed. In view of the hazardousness of an insulin overdose, this is to be avoided under all circumstances.

A method for manufacturing a micropump is discussed in EP 1 651 867 B1. The manufacturing of the known micropump is extraordinarily complex, because during the production process, in which different silicon layers are structured from two opposing sides, fragile intermediate states arise again and again, for example, as shown in FIGS. 3*b* and 3*c* of the publication, which must be supported in a complex fashion in order to avoid permanent damage to the micropump already during its manufacturing.

SUMMARY OF THE INVENTION

The exemplary embodiments and/or exemplary methods of the present invention are based on the object of proposing a method for the mass production of a micropump, in which fragile intermediate states are avoided. In addition, the object includes proposing a micropump which may be mass produced.

This object may be achieved with respect to the method described herein and with respect to the micropump described herein. Advantageous refinements of the exemplary embodiments and/or exemplary methods of the present invention are specified herein. All combinations of at least two features disclosed in the description, the claims, and/or the figures are also within the scope of the exemplary embodiments and/or exemplary methods of the present invention. To avoid repetitions, features disclosed with respect to the method are also to be considered as disclosed and able to be claimed with respect to the device. Features disclosed with respect to the device are also to be considered as disclosed and able to be claimed with respect to the method.

The exemplary embodiments and/or exemplary methods of the present invention are based on the idea of not manufacturing all microfluidic functional elements of the micropump, namely at least one intake valve, at least one pump chamber, and at least one outlet valve as in the related art, by structuring multiple layers from two sides, but rather producing all functional elements of the micropump exclusively by front side structuring, i.e., by structuring, in particular by etching, from only one direction, namely originating from a front side of a first carrier layer toward it. In other words, for manufacturing the micropump, it is proposed that at least one integral carrier, namely a first carrier layer, be provided, on whose front side multiple layers are applied, of which at least one layer is structured to manufacture the functional elements, and not from the rear side of the first carrier layer, which may be used as the support, but rather from the front side of the first carrier layer toward the first carrier layer. The first carrier layer may remain unstructured during the manufacturing of the functional elements and thus ensures absolute hermeticity between the front side of the first carrier layer and the rear side of the carrier layer, using which the carrier layer always rests on a so-called chuck of a processing station or facility during the manufacturing of the micropump. Because the carrier layer is present, which may be unharmed, during the production of the functional elements, fragile intermediate states are advantageously avoided during the manufacturing of the micropump, whereby support films, etc., may be dispensed with during the manufacturing and thus the requirements for mass production of the micropump are provided.

In a specific embodiment of the present invention, which may be after the manufacturing of the microfluidic functional elements by structuring of at least one layer, a second carrier layer may be provided in addition to the first carrier layer. This may particularly be a borosilicate glass wafer in this case, which is situated at a distance to the first carrier layer on the front side of the first carrier layer, whereby the at least partially structured layers, which are situated on the front side of the first carrier layer, are sandwiched between the first and the second carrier layers. The second carrier layer may be fixed by anodic bonding, in particular on the surface of what may be the structured layer which is furthest away from the first carrier layer. A specific embodiment may be provided in which the liquid is supplied to the intake valve and/or the liquid is removed from the outlet valve, in particular perpendicularly, through the second carrier layer, at least one fluid channel, which may be two fluid channels, being provided for this purpose in the second carrier layer. It is possible to introduce the fluid channels into the second carrier layer after it has been fixed. However, in a specific embodiment the at least one fluid channel may already be introduced into the second carrier layer before it is fixed, for example, by etching, or by laser bombardment, or by drilling, for example, using a diamond drill, or by ultrasonic drilling. The second carrier layer may particularly be situated in such a manner that it cooperates directly with an intake valve and/or an outlet valve of the micropump and/or directly delimits the at least one, which may be the exclusively one, pump chamber, in particular on the side diametrically opposite to the pump diaphragm.

By providing a second carrier layer, i.e., a second integral carrier or a second integral support layer, it is possible to remove the first carrier layer (after applying the second carrier layer) and thus to implement minimal dimensions of the micropump and simultaneously, by appropriately placing the intake valve and/or the pump chamber and/or the outlet valve, to provide space for installing actuators for the micropump, which are designed as piezoactuators in particular. The first carrier layer may be removed, for example, by isotropic etching, e.g., plasma etching, and/or back grinding and/or by wet etching. After the removal of the first carrier layer, an etch stop layer, which may also be indirectly situated on the front side of the first carrier layer and is to be explained hereafter, may also be removed, so that any actuators may act directly on the layer provided on the front side of the etch stop layer to control the pumping action. Reference is made to the description of the figures with respect to a procedure for removing the first carrier layer.

A specific embodiment of the manufacturing procedure in which the first carrier layer remains unstructured during the front side structuring of at least one layer situated in front of the first carrier layer, i.e., on its front side, i.e., at least during the manufacturing of all microfluidic functional elements, may particularly be used. This is possible in particular, because the layers are structured exclusively on the front side of the first carrier layer.

A specific embodiment of the manufacturing procedure in which the first carrier layer is a layer containing silicon, in particular a silicon layer, may particularly be used. It is conceivable to use a silicon wafer as the first carrier layer.

If a silicon wafer is used as the first carrier layer, a lower stop layer which may contain silicon oxide is applied directly to the silicon wafer. It may be a thermal oxide. At least one contact hole may be provided at a suitable position in order to allow electrical contacting originating from the first carrier layer to subsequently applied silicon. This electrical contact is advantageous for a later, above-mentioned anodic bonding of a second carrier layer, a current flow being required to form a high-strength bond to the second carrier layer, which may be configured as a glass substrate. If the stop layer is provided directly on the first carrier layer having at least one contact hole, it may be ensured that a stop layer section is located above the at least one contact hole, so that the etching action is reliably stopped in an area above the at least one contact hole if the first carrier layer is later to be removed by etching after the manufacturing of the functional elements, i.e., the etching procedure always meets a stop layer: either a "lower" stop layer to be explained hereafter or an "upper" stop layer (sacrificial layer) to be explained hereafter.

In a refinement of the exemplary embodiments and/or exemplary methods of the present invention, a base layer, which may contain silicon or is made of silicon, may be situated on the described stop layer, which is situated directly on the first carrier layer. According to a specific embodiment, this base layer forms the foundation or base layer of the finished micropump, to which actuators, which are explained hereafter, are applied directly. Functional element structures need not be provided in this base layer.

If a silicon wafer is not used as the starting material for the first carrier layer for manufacturing the micropump, it is alternatively possible to use a silicon-on-insulator wafer (SOI wafer), the first carrier layer being an integral component of the SOI wafer and forming the rear side of the SOI wafer. In a starting layer of this type, the application of the described stop layer and the described base layer may be dispensed with, because these are already integral components of the SOI wafer structure. In order to be able to apply the required voltage if bonding of the second layer by anodic bonding is intended, it is necessary to provide a suitable contact arrangement, in order, for example, to allow the current to be supplied directly to the front SOI wafer layer (in particular the base layer) via the wafer edge, for example, by clamps or spring contacts. This is necessary because in an SOI wafer, a contact hole is typically not provided in the stop layer it contains.

The base layer may be formed as epitaxially manufactured polycrystalline silicon (epi-polysilicon layer), the thickness may be in the range of approximately 11 μm. The base layer may optionally also be planarized, i.e., polished, for example, by so-called CMP (chemical-mechanical polishing).

Independently of the selected starting layer (silicon wafer or SOI wafer), in a refinement of the invention, an (upper) stop layer, which is used as the sacrificial layer, is deposited on the base layer and structured in such a manner that a thick stop layer (sacrificial layer) remains on selected surfaces. The stop layer may contain silicon oxide or is made thereof. Instead of the structuring of the stop layer after its application, it is also conceivable to only apply the stop layer in specific surface areas in a targeted manner. Surface areas in which the stop layer remains, in particular after appropriate structuring, will stop an etching process, in particular a silicon plasma etching process, during later manufacturing steps. The stop layer (sacrificial layer) may be selectively removed thereafter (therefore the designation "sacrificial layer"), for example, to produce freestanding, mobile functional element structures. As noted, the stop layer may be made of oxide and may be between approximately 4 μm and 5 μm thick, for example. In the manufacturing variant "SOI wafer," for example, a thermal oxide may be grown up to a thickness of approximately 2.5 μm and an oxide which is approximately 1.8 μm thick may also be deposited thereon, for example, in the form of TEOS or plasma oxide, which results in a total oxide thickness of 4.3 μm. In the manufacturing variant "silicon wafer," thermal oxidation may be dispensed with, because intolerable stress gradients would be introduced thereby into the base layer (which may be epi-polysilicon), which would make the further use as a mechanical layer material impossible. For the case "silicon wafer," the full oxide thickness may be deposited as TEOS or plasma oxide.

In a refinement of the exemplary embodiments and/or exemplary methods of the present invention, it is advantageously provided that a functional layer is situated on the stop layer, which is situated, which may be directly, in areas on the front side of the base layer, and in the areas of the base layer not encompassed by the stop layer. The functional layer may be an epi-polysilicon layer for this purpose, which may have a thickness between approximately 15 μm and 24 μm. In particular if anodic bonding (second carrier layer) must be performed later on the surface of the functional layer, a planarization of the surface, for example by a CMP method, particularly may be used, independently of whether the base layer was already planarized (either applied to a stop layer or a component of an SOI wafer structure). The planarization layer must level out the topography of the surface of the functional layer and microscopically "smoothe" the areas for bonding.

In a refinement of the exemplary embodiments and/or exemplary methods of the present invention, it is advantageously provided that at least one depression is introduced into the front side of the optional layer, which may have a depth between approximately 2 μm and 5 μm, in order to avoid contact with the second carrier layer to be bonded in this area, in particular because at least one mobile functional element may be connected to at least one depressed area.

A specific embodiment is particularly advantageous in which at least one anti-bond layer is applied as a valve sealing surface on the front side of the functional layer, which may be in at least one area enclosed by at least one depression. The anti-bond layer must be composed in such a way that it does not adhere to the second carrier layer during an anodic bonding action, during which the second carrier is fixed on the functional layer. For example, the anti-bond layer may be implemented in the form of silicon nitride or silicon carbide or graphite, etc. Additionally or alternatively to providing at least one anti-bond layer on the front side of the functional layer, it is possible to provide at least one anti-bond layer on the second carrier layer, in particular in the area of the intake valve and/or the outlet valve, which reliably prevents adhesion of the second carrier layer to the functional layer even during an anodic bonding process.

The functional layer may be structured, for example, by trench etching, in such a manner that an intake valve structure and/or a pump structure and/or an outlet valve structure are at least partially produced in the functional layer, i.e., functional elements of the micropump are at least partially provided.

A specific embodiment of the manufacturing method in which the produced intake valve structure and/or the outlet valve structure include at least one coiled spring section may particularly be used. The at least one coiled spring may carry the valve plunger of the particular valve. Multiple, for example, two to five, coiled springs of this type, which may be three coiled springs, may also be nested in one another in such a manner that the central valve plunger is held fully symmetrically thereby and any intrinsic stress in the springs may be completely dissipated by a minimal twist of the valve plunger. A soft suspension of the central valve plunger in the Z direction (i.e., perpendicular to the surface extension of the first and second carrier layers) is implemented by the relatively great spring lengths, the spring height corresponding to nearly the entire functional layer height. In this state, the at least one intake valve plunger and/or the at least one outlet valve plunger is still fixedly seated on the stop layer or sacrificial layer situated below the functional layer.

In particular in order to make the intake valve plunger adjustable in the Z direction and/or to enlarge the pump chamber and/or the outlet valve chamber, in a refinement of the exemplary embodiments and/or exemplary methods of the present invention, the (upper) stop layer, which is used as a sacrificial layer, adjoining the functional layer is removed in a way known per se, for example, with the aid of liquid or vaporized hydrofluoric acid. After this etching procedure, the functional unit "intake valve" is freely mobile and may thus be deflected in the Z direction. The distance of the at least one coiled spring to the base layer may correspond to the thickness of the previously removed stop layer (sacrificial layer), which may be approximately 4 μm to 5 μm. It is advantageous that as many areas as possible of the described stop layer are also removed during the described etching process, because they would later introduce undesired compression stress into the mechanical structure of the micropump.

The exemplary embodiments and/or exemplary methods of the present invention also results in a micropump, in particular for high-precision delivery of insulin, the micropump having multiple functional elements, such as at least one intake valve and at least one outlet valve and at least one pump chamber. A micropump designed according to the concept of the exemplary embodiments and/or exemplary methods of the present invention is distinguished in that all functional elements of the micropump of this type are exclusively manufactured by structuring layers from one direction. In other words, the functional elements are not produced by two-sided structuring processes, but rather only by structuring processes which are performed from one direction and from one side. Fragile manufacturing states may thus be avoided and the micropump may be mass produced at high yield.

In a refinement of the exemplary embodiments and/or exemplary methods of the present invention, the micropump has a carrier layer, in particular made of borosilicate glass, in which at least one fluid channel, in particular an intake channel and/or an outlet channel, is/are introduced. In addition, the carrier layer may directly delimit the pump chamber.

A specific embodiment of the present invention in which the at least one, which may be exclusively one, intake valve includes at least one coiled spring, which is situated in such a way that it ensures a soft suspension of the valve plunger of the intake valve in the Z direction, is particularly advantageous. A specific embodiment having multiple nested coiled springs may be particularly used, in order to be able to dissipate undesired material stress.

With respect to a use of the micropump as an insulin delivery pump for high-precision insulin metering, a specific embodiment may particularly be used in which the intake valve of the micropump may be actively sealed using at least one actuator, which may be a piezoactuator, i.e., a specific embodiment in which the intake valve of the micropump may be kept closed by appropriately triggering at least one actuator, in order to thus prevent insulin entry into the micropump even for the case in which pressure is applied to the insulin supply itself. In other words, the delivery volume of the micropump becomes independent of the initial pressure in the insulin supply container, thereby achieving a high metering accuracy. Above all, undesired drug flows or back flows of a delivered metering quantity are suppressed by the described specific embodiment and the metering dispensation is strictly linked to a so-called "stroke volume," which is the quantity corresponding to one pump stroke.

In a specific embodiment a valve sealing surface of the intake valve, which is situated on a valve plunger in particular, may be pressed against the carrier layer using at least one actuator in order to thus avoid unintentional inflow of fluid, in particular insulin, into the micropump. A valve sealing surface of an outlet valve may also be pressed actively against the carrier layer using at least one actuator.

The mode of operation of an exemplary embodiment of a micropump is described hereafter: which may be, the micropump, including a drug supply (which may be an insulin supply) and optionally also an attached injection needle or a microneedle array may be installed, in particular clipped in, as a so-called "disposable article" in a device which represents the so-called "pump" for the end-user. The "pump" may contain the control electronics, the power supply, for example by batteries or storage cells, a user interface, and/or a wireless interface to a user interface or to a telemedicine apparatus, or optionally also a wireless interface to a blood sugar value determination apparatus, which transmits measured blood sugar data to the "pump" for further processing. The "pump" may also contain the actuators of the micropump. These are up to three actuators, which may be three actuators, which act on positions provided for this purpose on the micropump, which may be on the intake valve, on the pump diaphragm (i.e., on the pump chamber), and on the outlet valve. The up to three actuators may be configured in the form of so-called piezostacks, i.e., systems of piezoelectric discs or individual elements connected in series in a cascade to form a piezoactuator in each case, which becomes shorter or longer through an applied electrical voltage, depending on the polarity of the electrical voltage in relation to the polarization of the piezoelements.

First, the pump function will be described using a system made of three actuators, although it is possible to dispense with individual actuators and to relinquish the corresponding partial function or additional safety mechanism connected thereto.

After the installation of the micropump in the receptacle device ("pump") provided for this purpose, the actuators are conditioned, i.e., brought once into a defined position and fixed there:

so that a first actuator presses on a diaphragm (which may be the base layer) below the intake valve plunger and the intake valve is closed and blocked against the second carrier layer via this diaphragm, so that a second actuator just rests flatly on the diaphragm (which may be the base layer) of the micropump and thus defines its "starting position," or alternatively simply presses the diaphragm through up to the stop formed by the second carrier layer;

so that a third actuator presses on the area of the outlet valve plunger (in particular on the base layer) and closes and blocks it against the second carrier layer.

The conditioning may be performed manually or which may be automatically (for example, motor-driven), in that, for example, an actuator block, including the three actuators positioned relative to one another, is moved forward as a unit, until a resonant frequency change of one of the actuators (which may be the piezostack) indicates, for example, that a contact has occurred with the micropump, in particular the base layer, or a force is acting on the actuators. Because the actuator block is advantageously moved forward as a unit and the individual actuators of the block were correctly positioned relative to one another beforehand by the manufacturer, the measurement on a single actuator, in particular on a single piezoelement, is sufficient in order to detect that the entire system has reached the correct location. For example, the contact of the actual pump diaphragm (which may be the base layer) with the second actuator is very easy to detect via its vibration behavior during electrical resonance excitation. The core idea of this conditioning method is that if only one actuator is advanced into its target position, the target positions of the other actuators are also automatically correct, because they have been adjusted relative to one another on the actuator block. The method of simply bringing an actuator to a hard stop is particularly simple, because it may be performed without measurement, i.e., for example, blocking the intake valve and/or the outlet valve or pressing through the pump diaphragm up to the stop. For this purpose, the actuator block is advanced using defined force until no further movement is possible because of the hard stop. An active measurement of the actuator position (for example, by resonant frequency change) is superfluous in this case.

In a particular embodiment of the conditioning method, the conditioning is performed with the aid of at least one single spring or a spring system, which simply presses the actuator block forward against the micropump without a further motor system. If at least one of the valves, either the intake valve or the outlet valve, is to be mechanically blocked, i.e., at least one of the two actuators acts unshortened on the micropump or its valve seats, the target position of the actuator block relative to the micropump is always defined. It is never provided in operation of the pump that both the intake valve and also the outlet valve are both simultaneously unblocked, i.e., both associated actuators would be shortened. This functional feature allows particularly simple positioning of the actuator block using a spring, which only must be sufficiently strong to block the two valves reliably and press them against their stops—their valve seats. The position of the entire actuator block is thus also defined. The micropump is only inserted or clipped into the position provided for this purpose, for example, within a guide or in a lateral frame in the "pump," the actuator block having to be pushed back somewhat, which may be manually, for example, in order to be able to receive the micropump. If the micropump has been brought into position, the springs of the actuator block are permitted to simply press the latter against the micropump, whereby, for example, both the intake valve and also the outlet valve are blocked and simultaneously the actuator assigned to the pump diaphragm is also exactly defined in its position relative to the pump diaphragm.

In particular if a high dynamic response of the pumping action is to be dispensed with, it is possible to do without the pump diaphragm actuator (second actuator), for example, and replace it with a rigid spacer element, for example, which presses on the pump diaphragm (which may be the base layer). In this case, the two valve actuators may suffice to also apply the pumping action themselves via the actuator block and the spacer element. For example, if the outlet valve is to be unblocked and subsequently the pump diaphragm is to be brought into contact via "stroke," the outlet valve actuator may be retracted by the thickness of the base layer of, for example, approximately 20 μm plus an additional offset of approximately 5 μm, which may be while exploiting the piezoeffect. The intake valve actuator, for example, is subsequently retracted somewhat less than the base thickness layer, i.e., for example, 19.5 μm, whereby the spacer element, which is central in particular, advances with the actuator block by just this distance and pushes the pump diaphragm (which may be the base layer) against its stop (which may be the second carrier layer) or nearly against its stop. In all described cases, it is very easily possible to bring the actuator block independently, through at least one simple spring or spring system, into the desired position relative to the micropump, which results in ready handling during use of the micropump and also provides intrinsic safety: it is ensured by the passive spring action that in the electrically deenergized state, all valves are blocked, i.e., "normally closed behavior" is provided. In this configuration, no insulin may pass through the micropump, even if the supply container is placed under pressure, because both the intake valve and also the outlet valve are pressed closed by one actuator each.

The micropump operates as follows if three actuators are provided:

Before a pump stroke, the actuator directly assigned to the outlet valve is retracted by applying an electrical voltage to the piezostack, for example, whereby the outlet valve is unblocked. This does not yet mean that the outlet valve is opened; rather, it remains closed until it is opened by an overpressure in the interior of the micropump. Only then may insulin leave the micropump. Because the intake valve may still be blocked, no insulin may reach the micropump from the insulin supply.

The actuator directly assigned to the diaphragm of the micropump is now lengthened, which may be done by applying an electrical voltage, and presses the pump diaphragm (which may be the base layer) through up to the upper stop, i.e., which may be up to the second carrier layer. The so-called "stroke volume" is dispensed by the outlet valve.

As the next step, the outlet valve is blocked by lengthening the actuator assigned thereto (for example, by removing the electrical voltage which had shortened the actuator or briefly reversing the polarity of the voltage and only then setting it to zero) and then shortening the first actuator assigned to the intake valve, for example, by applying an electrical voltage, whereby the intake valve is unblocked, but not yet opened. Rather, the intake valve remains closed, even against an overpressure from the outside in the insulin supply, because nothing may flow out of the micropump as a result of the blocked outlet valve. The intake valve is opened and a "stroke volume" of insulin reaches the micropump only when the second actuator assigned to the pump chamber is shortened, for example, by removing the electrical voltage applied to the piezostack, and the pump diaphragm (which may be the base layer) moves back into its starting position. The first actuator assigned to the intake valve is then electrically deenergized again, whereby it stretches out up to its starting length and again blocks the intake valve. The pumping procedure may then be repeated. The third actuator (outlet valve actuator) unblocks the outlet valve, the second actuator (pump actuator) performs a "stroke," and the "stroke volume" is delivered from the micropump through the outlet valve. The third actuator blocks the outlet valve and the first actuator unblocks the intake valve, upon which the second actuator returns the pump diaphragm to its starting location, the previously dispensed "stroke volume" being replaced again from the insulin supply container via the intake valve and reaching the micropump, upon which the intake valve is blocked again using the first actuator, etc.

It is essential that only the "stroke volume" always reaches the micropump, independently of any possible initial pressure in the supply container, and precisely this "stroke volume" is also always delivered from the micropump, without a harmful backflow into the micropump. The metering is thus very accurate and the micropump is intrinsically safe, even in the event of overpressure in the supply container. Because of their high longitudinal rigidity, piezoactuators suggest themselves as the actuators, on the basis of which the function of the micropump was described as an example. However, it is also possible to use other actuators, for example, thermal or electrical actuators, in particular having corresponding spring systems, as actuators, additionally or alternatively to piezoactuators.

Further advantages, features, and details of the present invention result from the following description of exemplary embodiments and on the basis of the drawings.

DETAILED DESCRIPTION

Figure 1:
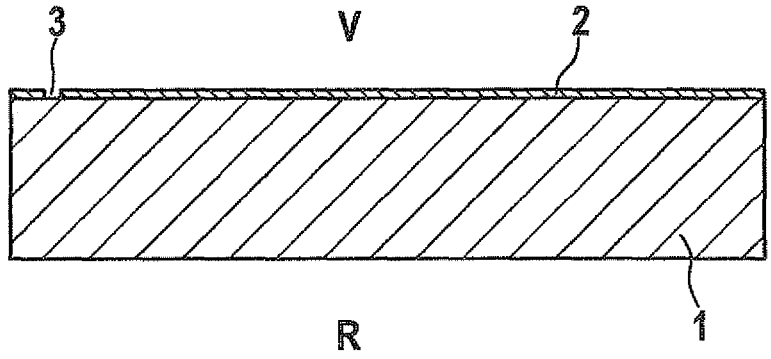
FIG. 1 shows an initial method step for manufacturing a micropump starting from a silicon wafer as the first carrier layer.

Identical components and components having identical functions are identified using identical reference numerals in the figures.

Figure 10:
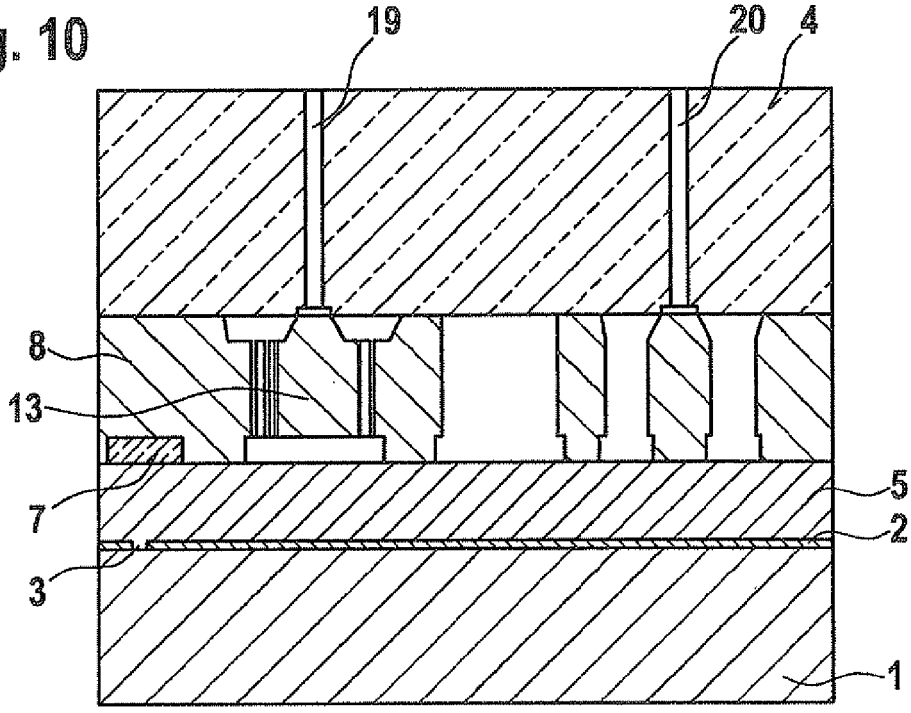
FIG. 10 shows important manufacturing step(s) for manufacturing a micropump, the first carrier layer being designed as a silicon wafer in the method steps shown.

In FIG. 1, the manufacturing of a micropump starts beginning with a silicon wafer as first carrier layer 1, which is provided on its front side V with a (thermal) oxide as lower stop layer 2, in which contact holes 3 for an electrical contact between the base carrier layer material silicon and subsequently applied silicon layers are applied at a suitable location. The electrical contacts are advantageous for a later, so-called anodic bonding process, in which a current flow is required for the production of a high-strength bond to a second carrier layer 4 (here: glass substrate), which is shown in FIG. 10, for example.

Figure 2:
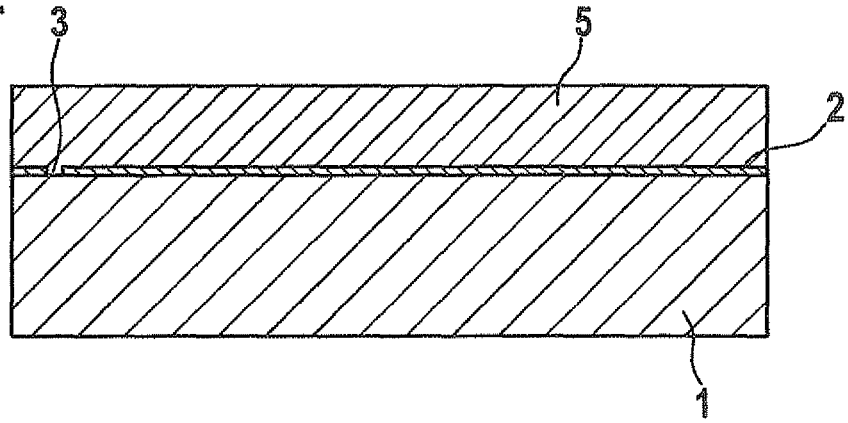
FIG. 2 shows another initial method step for manufacturing a micropump starting from a silicon wafer as the first carrier layer.

FIG. 2 shows a further intermediate stage of the micropump, a base layer 5, which is designed as an epi-polysilicon layer, having been applied to the front side of lower stop layer 2 during its manufacture. In this exemplary embodiment, the thickness of base layer 5 is 11 μm. Base layer 5 may optionally be planarized, for example, by a CMP step.

Figure 3:
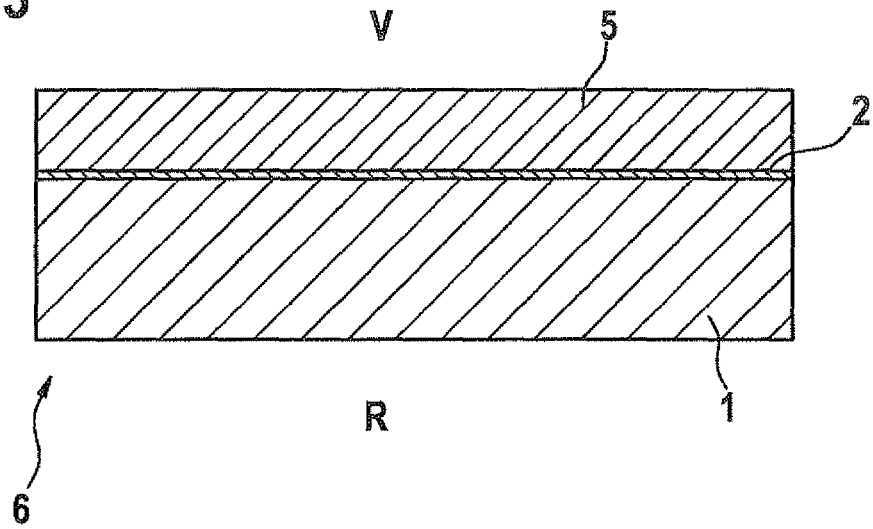
FIG. 3 shows an alternative starting point for a manufacturing method for manufacturing a micropump, starting from an SOI wafer.

FIG. 3 shows an alternative starting point for the manufacturing process, which starts with a so-called SOI wafer 6 as the starting material. The steps of films 1 and 2 may be dispensed with, because a higher quality semifinished product is already used as the starting material. However, it is disadvantageous in this case that there is no electrically conductive connection available from lower, first carrier layer 1 to upper base layer 5, which is situated on front side V of first carrier layer 1, of SOI wafer 6 via contact holes. A suitable contact arrangement must be provided via the wafer edge for later anodic bonding, such as clamps or spring contacts, which electrically contact upper base layer 5 of SOI wafer 6 from the edge, for example.

Figure 4:
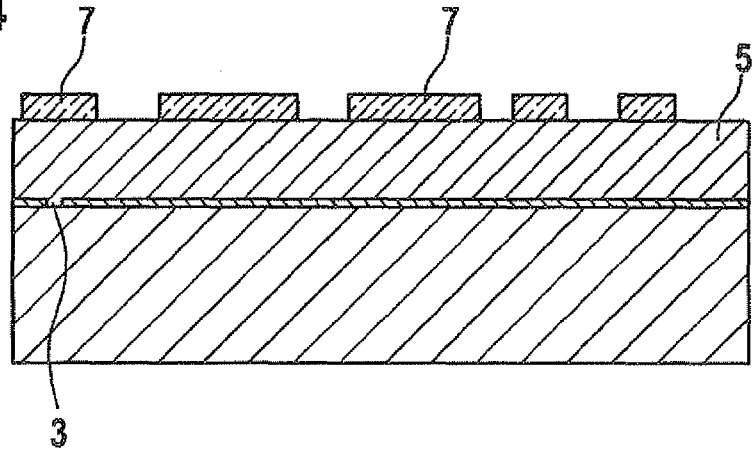
FIG. 4 shows important manufacturing step(s) for manufacturing a micropump, the first carrier layer being designed as a silicon wafer in the method steps shown.

FIG. 4 shows the continuation of the manufacturing process, independently of whether the variant according to FIGS. 1 and 2 or the variant according to FIG. 3 is followed. The variant according to FIGS. 1 and 2 is illustrated hereafter on the basis of FIGS. 4 through 12, which begins from a silicon wafer as the starting point (first carrier layer 1)—the "SOI wafer" variant may be readily derived therefrom.

A thick oxide is deposited on the front side of base layer 5 as upper stop layer 7 and structured in such a way that stop layer 7, which is used as the sacrificial layer, remains on selected surfaces. These selected surfaces are all areas in later manufacturing steps in which a silicon plasma etching process must be stopped and/or a freestanding mobile structure is to result. It is essential that a stop layer 7 is provided directly above contact holes 3.

In the exemplary embodiment shown, the thickness of upper stop layer 7 is approximately 4 μm to 5 μm. In the "SOI wafer" variant, for example, a thermal oxide up to a thickness of 2.5 μm is grown and an oxide which is 1.8 μm thick is deposited over it, for example, in the form of TEOS or plasma oxide, which results in a total stop thickness layer of at most approximately 4.3 μm. In the variant which begins with a silicon wafer as the first carrier layer, thermal oxidation is not recommended, because intolerable stress gradients would be introduced into the base layer material (epi-polysilicon) in this manner, which would make the further use as a mechanical layer material impossible. For the last-mentioned case, the deposition of the full stop layer thickness (oxide thickness) may be performed as TEOS or plasma oxide at relatively low temperatures of 300° C. to 450° C., for example.

Figure 5:
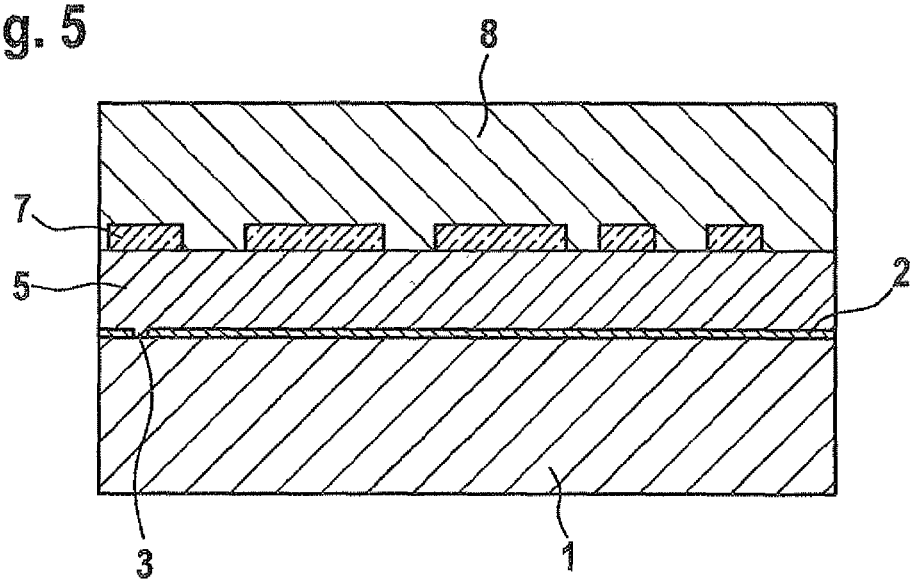
FIG. 5 shows important manufacturing step(s) for manufacturing a micropump, the first carrier layer being designed as a silicon wafer in the method steps shown.

In FIG. 5, a manufacturing step is shown in which a functional layer 8 having a thickness of approximately 15 μm to 24 μm was deposited on the front side of base layer 5 and on the front side of stop layer 7. Functional layer 8 is made of an epi-polysilicon layer in the exemplary embodiment shown. Because anodic bonding must be performed later on the front side (layer surface) of functional layer 8, planarization of the surface, for example, by a CMP method, is to be unconditionally recommended here, independently of whether base layer 5 was already planarized beforehand or an SOI wafer layer was used for the base layer. The planarization step must level out the topography of the surface and microscopically "smoothe" the surfaces for bonding.

Figure 6:
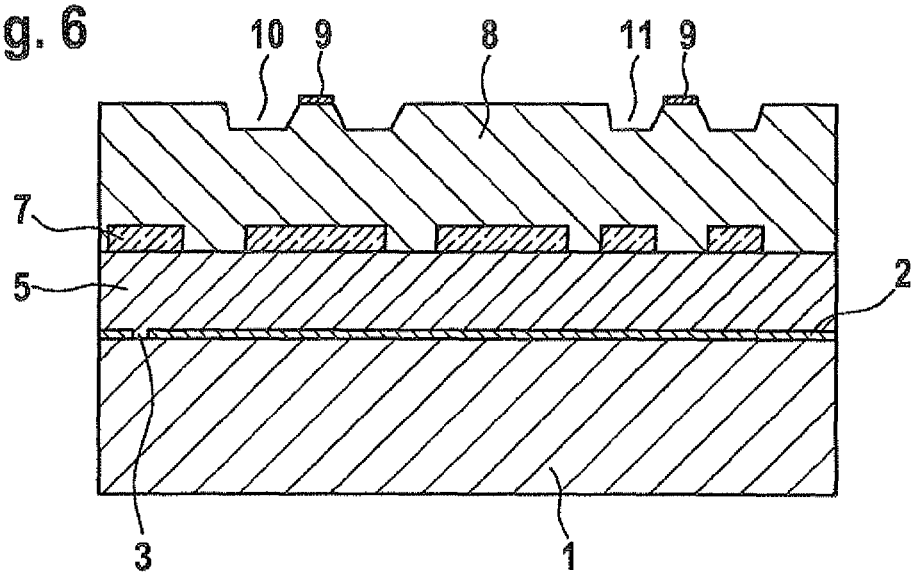
FIG. 6 shows important manufacturing step(s) for manufacturing a micropump, the first carrier layer being designed as a silicon wafer in the method steps shown.

In FIG. 6, the wafer stack is shown after the application and structuring of an anti-bond layer 9, which must remain on the later valve sealing surfaces. Anti-bond layer 9 may be made of silicon nitride, silicon carbide, or graphite, for example. In addition, recesses 10, 11 have been etched around anti-bond layer surface areas 9 at a depth of approximately 2 μm to 5 μm. These recesses 10, 11 are not to come into contact with second carrier layer 4 to be bonded later, in order to guarantee a mobility of microfluidic functional elements to be manufactured, an intake valve plunger 14 and an outlet valve plunger 17 here.

Figure 7:
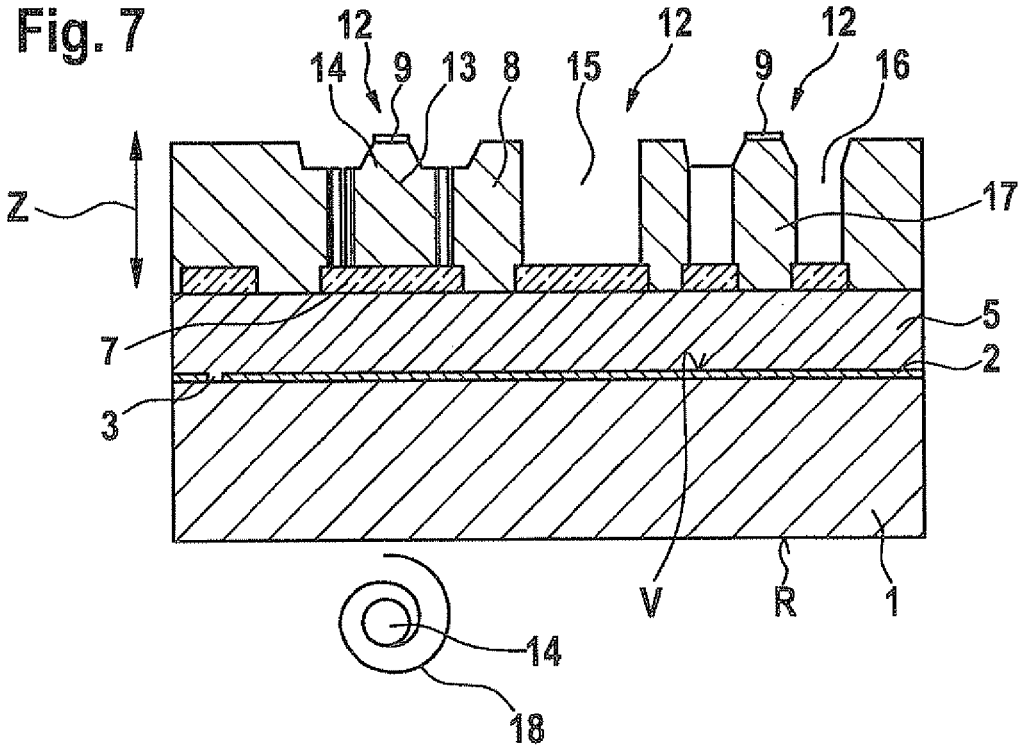
FIG. 7 shows important manufacturing step(s) for manufacturing a micropump, the first carrier layer being designed as a silicon wafer in the method steps shown.
Figure 8:
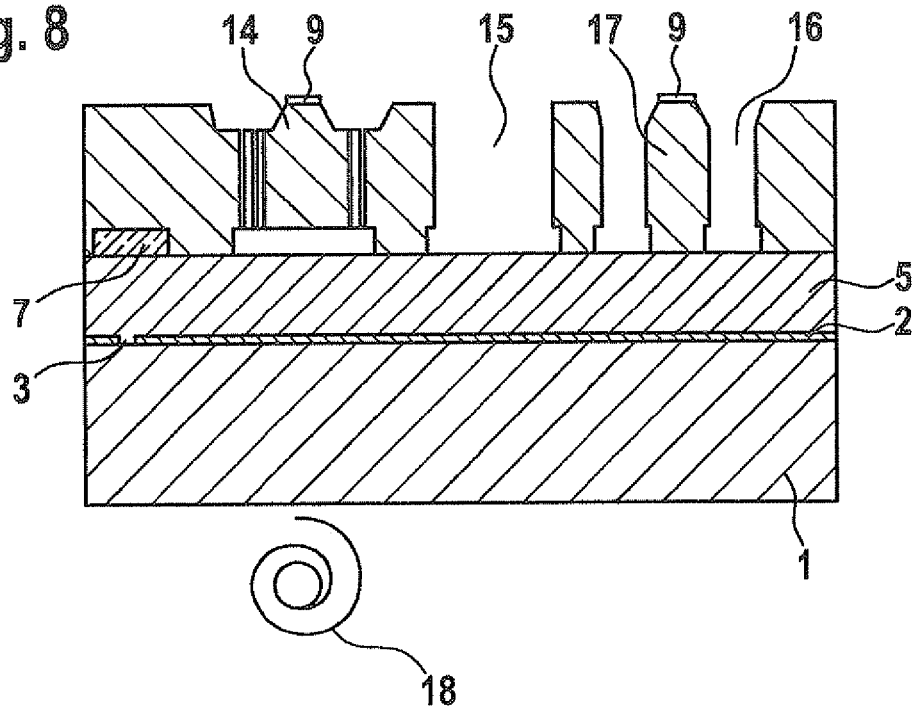
FIG. 8 shows important manufacturing step(s) for manufacturing a micropump, the first carrier layer being designed as a silicon wafer in the method steps shown.

In FIG. 7, functional layer 8 has been structured, inter alia, in the area below recesses 10, 11. In other words, microfluidic functional elements 12 are provided thereby, namely an intake valve 13 having an intake valve plunger 14, on whose front side anti-bond layer 9 is located as the valve sealing surface. Furthermore, a pump chamber 15 and an outlet valve 16 having an outlet valve plunger 17 are provided, an anti-bond layer 9 also being located as the sealing surface on the front side of outlet valve plunger 16. Functional elements 12 are not yet finished in the method step according to FIG. 7. For this purpose, it is still necessary, as shown in FIG. 8, to selectively remove upper stop layer 7 (sacrificial layer). This may be performed in a way known per se by liquid or vaporized hydrofluoric acid. After this etching, intake valve 13 or intake valve plunger 14 is freely mobile and may particularly be deflected in the Z direction. The distance of intake valve plunger 14 to base layer 5 corresponds to the thickness of the previously removed oxide (upper stop layer 7 (sacrificial layer)) of 4 μm to 5 μm.

The implementation of intake valve 13 is noteworthy here. In the exemplary embodiment according to FIG. 7, it includes a coiled spring 18, which is shown in a top view below the wafer stack in FIG. 7. Coiled spring 18 carries intake valve plunger 14 on its end, whereby a soft mounting of intake valve plunger 14 in the Z direction is provided and material stress may relax.

Figure 16:
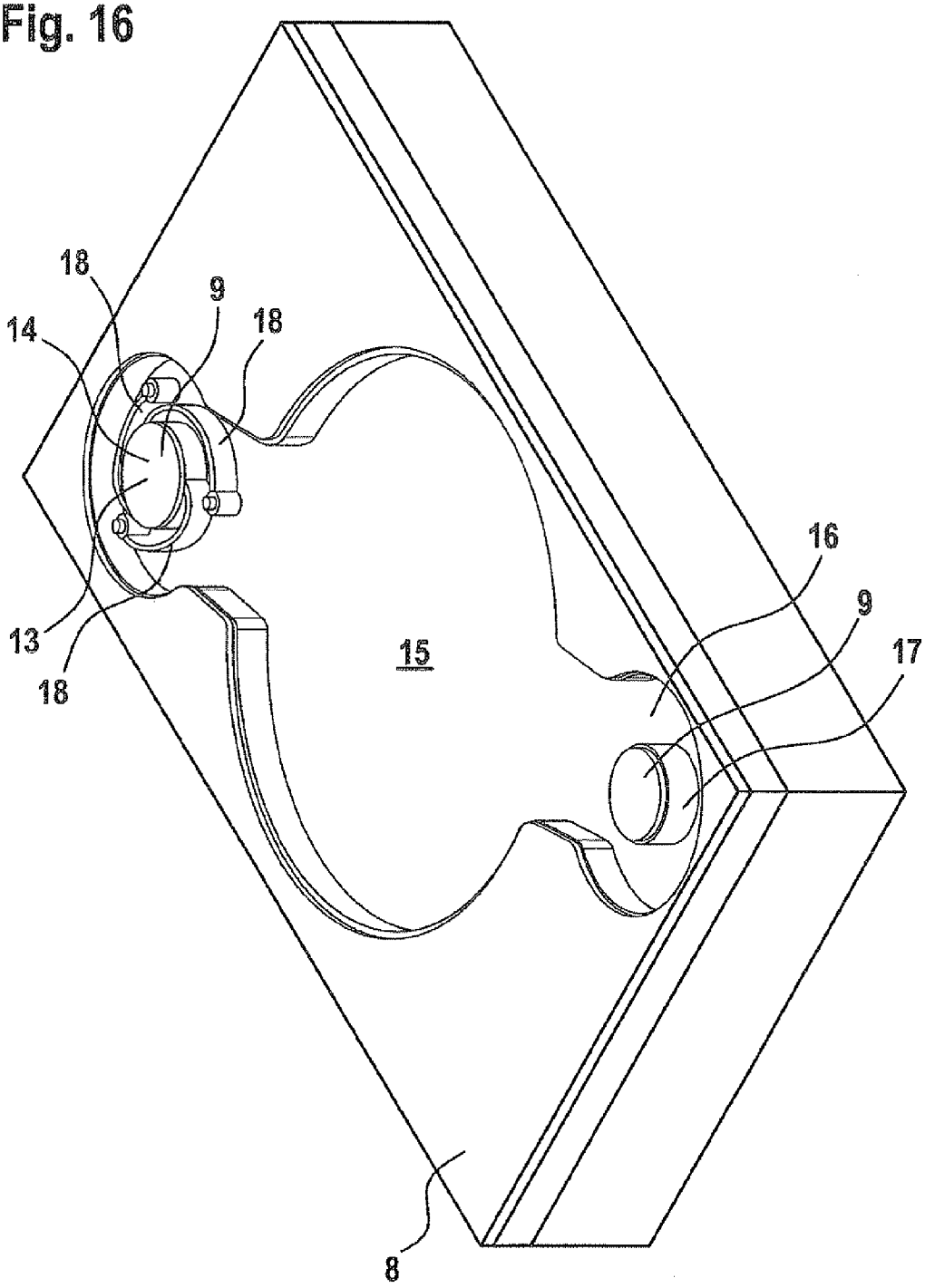
FIG. 16 shows a perspective view of a not yet finished micropump during its manufacturing.

An alternative specific embodiment of intake valve 14 results from the perspective view according to FIG. 16. Three nested coil springs 18 are shown, which are all connected at one end to intake valve plunger 14 at uniformly distributed positions around the circumference. Central intake valve plunger 14 is held completely symmetrically by coiled springs 18 and any intrinsic stress of the coiled springs is completely dissipated by a minimal twist of intake valve plunger 14. A soft suspension of the central intake valve plunger in the Z direction is implemented by the relatively great spring lengths, the spring height corresponding to nearly the entire sacrificial layer height. Furthermore, the structure and the configuration of outlet valve 16 having its central valve plunger 17 is shown in FIG. 16. It may be seen from FIG. 16 that both an intake valve chamber and also an outlet valve chamber and pump chamber 15 are contoured as circular and are connected to one another via large opening cross sections.

As previously noted, an intermediate step of the manufacturing of the micropump is shown in FIG. 8, in which (upper) stop layer 7 (sacrificial layer) was selectively removed. Intake valve 13 is first unblocked in this manner. Previously, intake valve plunger 14 still sat fixedly on the thick oxide which forms stop layer 7 (sacrificial layer), and which has also formed the etch stop for the plasma etching process for structuring functional layer 8.

It is clear from FIGS. 6 through 8 in particular that the manufacturing of functional elements 12 is exclusively performed by front side structuring, i.e., by structuring in a direction toward front side V of the first carrier layer. Carrier layer 1 was not involved here, because it has been structured through.

Figure 9:
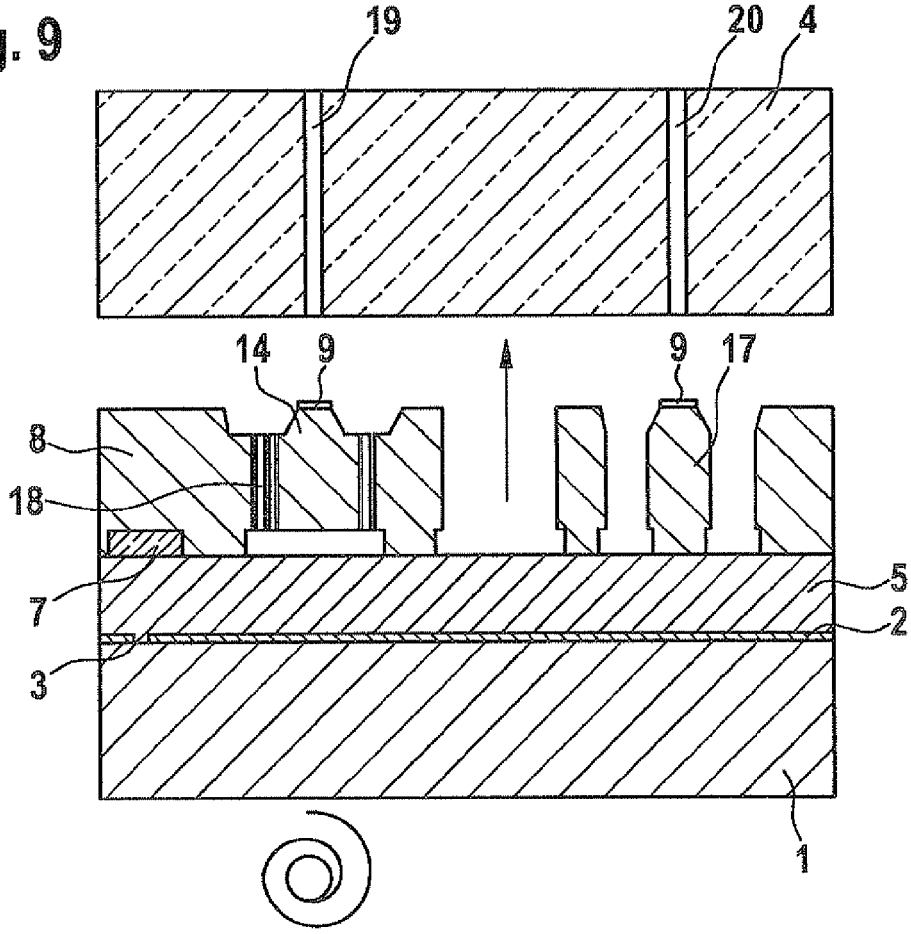
FIG. 9 shows important manufacturing step(s) for manufacturing a micropump, the first carrier layer being designed as a silicon wafer in the method steps shown.

FIG. 9 illustrates an anodic bonding process: Pre-structured second carrier layer 4, a borosilicate glass wafer here (such as a Pyrex glass wafer), has holes at appropriate positions as fluid channels 19, 20. Left fluid channel 19 in the drawing forms an intake channel for supplying drug (insulin) and fluid channel 20, which is on the right in the plane of the drawing, forms an outlet channel for letting out a "stroke" volume. Fluid channel 19 may be connected to a storage tank or storage bag having insulin and fluid channel 20 is attached to an injection needle or particularly to a microneedle array, for example, made of porous silicon, etc. The peripheral edges of the lower ends of fluid channels 19, 20 form the valve seats for intake valve plunger 14 and outlet valve plunger 17. The anti-bond layer surface sections form the sealing surfaces of intake valve 13 and outlet valve 16. Additionally or alternatively to anti-bond layer 9, anti-bond surfaces (not shown) may be provided as seat surfaces on the rear side of second carrier layer 4.

For the anodic bonding process, functional layer 8 must be contacted using an electrical voltage source and positively polarized in relation to second carrier layer 4, which is applied with calibration. In the variant shown, starting from a silicon wafer as first carrier layer 1, this contacting is readily possible via first carrier layer 1 because of contact holes 3 in lower stop layer 2. Voltages from a few hundred volts to a few thousand volts are used in a way known per se, depending on the thickness of second carrier layer 4. A high-strength, high-precision, and irreversible bonding of the contact surfaces to one another is achieved by the anodic polarity of the front side or the silicon surface of sacrificial layer 8 in relation to second carrier layer 4, without an adhesive being required for this purpose. The latter is decisive in connection with the restricted stability and bioactivity of insulin, which would be impaired in its effectiveness by many materials, such as many plastics or adhesives. In the micropump shown, the insulin only comes into contact with silicon, borosilicate glass, and the anti-bond layer inside the micropump—all of these materials have good insulin compatibility.

FIG. 10 shows the bonded wafer structure after the performance of the anodic bonding process.

Figure 11:
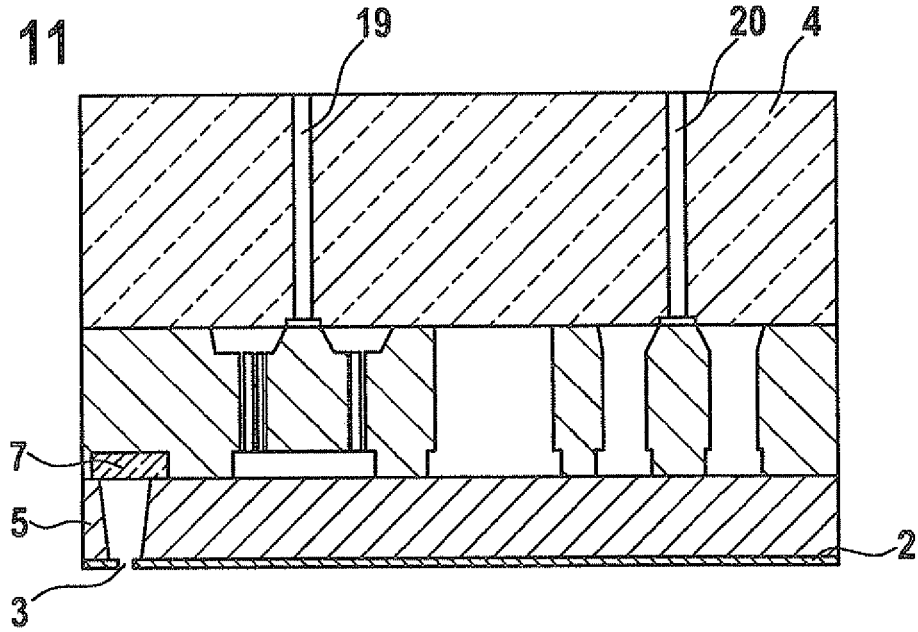
FIG. 11 shows important manufacturing step(s) for manufacturing a micropump, the first carrier layer being designed as a silicon wafer in the method steps shown.

In FIG. 11, first carrier layer 1 has been removed. The back thinning of first carrier layer 1 may be performed by back grinding, plasma etching, or a combination of back grinding and plasma etching. Alternatively, wet etching may also be performed, for example, in hot potassium hydroxide solution employing an etching mask as the front side protection. The removal of complete first carrier layer 1 by plasma etching is particularly gentle, because no mechanical action occurs here. Because anisotropic etching is not required for this purpose per se, for example, an isotropic $SF_6$ process having advantageous higher ablation rates of 50 to 100 μm/minute or more may be used for etching, for example, so that the removal of first carrier layer 1 only takes a few minutes. Because an etching attack on base layer (silicon here) lying above it up to (second) stop layer 7 occurs via contact holes 3, it is advantageous to change over from purely isotropic plasma etching to at least partially anisotropic plasma etching in the final phase of the process. The advantage of anisotropy is in the case in which contact holes 3 may be overetched, for example, to compensate for etching inhomogeneities or wafer thickness variations over the wafer surface, without the etching into the base layer in the contact hole areas becoming ever larger laterally. The disadvantage is the lower etching speed during anisotropic etching. The changeover from a purely isotropic etching process to an at least partially anisotropic plasma etching process may be implemented in that, according to the teaching of DE 42 410 45 A1, the isotropic $SF_6$ etching step is alternately performed toward the end of the back etching with so-called passivation steps using $C_4F_8$ or $C_3F_6$ as the passivation gas, for example. The detection of this transition may be performed using an optical endpoint detection via "optical emission spectroscopy"—so-called OES—in that the reaching of lower (first) stop layer 2 at any location is detected and the passivation steps are incorporated for the further etching or further overetching, so as not to excessively laterally expand contact holes 3, which have already been attacked in the etching, during the overetching. The thick oxide layer which is opposite to contact hole 3 is etch-limiting in the vertical direction in each case. Using this procedure, inhomogeneities of the etching process itself or wafer thickness variations may be compensated for by overetching without penalty. The OES endpoint detection system indicates whether the first carrier layer, i.e., all of the silicon, was removed from lower stop layer 2 and the process has reached its end.

Figure 12:
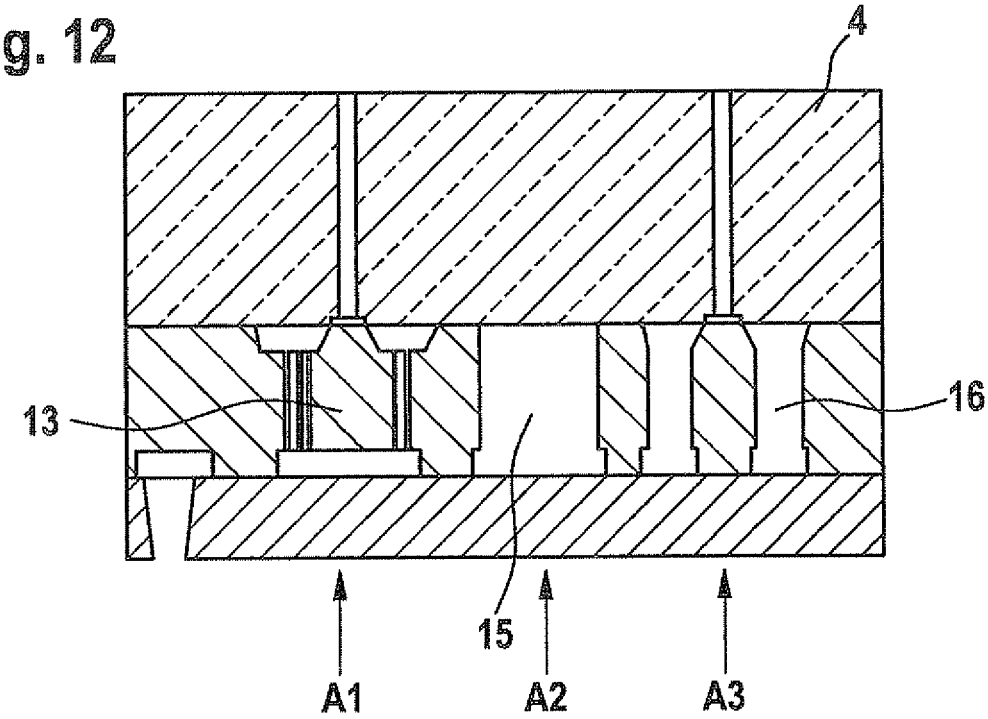
FIG. 12 shows important manufacturing step(s) for manufacturing a micropump, the first carrier layer being designed as a silicon wafer in the method steps shown.

FIG. 12 shows the removal of still remaining stop layers 2, 7: on the one hand, flat lower stop layer 2, on the other hand, upper stop layer 7 (sacrificial layer) (etch stop area above open contact holes 3). The removal may again be performed by liquid or vaporized hydrofluoric acid. Because oxide layers in particular introduce strong compression stresses into the mechanical structure, it is advantageous to remove all oxide layers at the process end.

Furthermore, a possible system of a first actuator A1, a second actuator A2, and a third actuator A3 is shown in FIG. 12. First actuator A1 is assigned directly to intake valve 13, second actuator A2 is assigned directly to pump chamber 15, and third actuator A3 is assigned directly to outlet valve 16. It may be seen that all actuators A1 through A3 act directly on base layer 5, which delimits the micropump on the side facing away from second carrier layer 4. Reference is made to the general part of the description with respect to the mode of operation and a possible triggering of actuators A1 through A3. In particular, it is to be noted that if needed, for example, second actuator A2 may be dispensed with (compare general part of the description).

Figure 13:
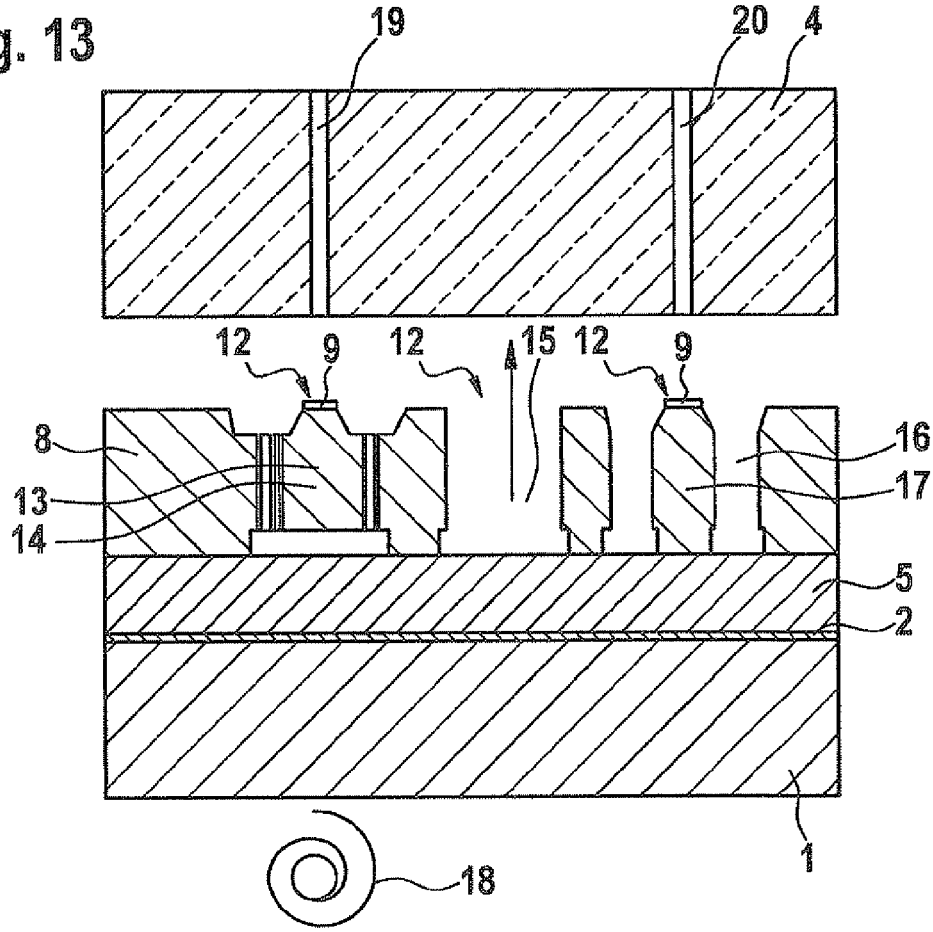
FIG. 13 shows essential method steps during the manufacturing of a micropump, the first carrier layer being part of the SOI wafer here, the method step according to FIG. 13 corresponding to the method step according to FIG. 9.

FIG. 13 illustrates the bonding process for the case of the "SOI wafer" variant. Except for the difficulty of electrically contacting the upper SOI layer (base layer 5) via contact springs, etc., from the side or via the wafer edge, because there are no contact holes to lower, first carrier layer 1, the structure and the procedure correspond precisely to the counterpart of FIG. 9.

Figure 14:
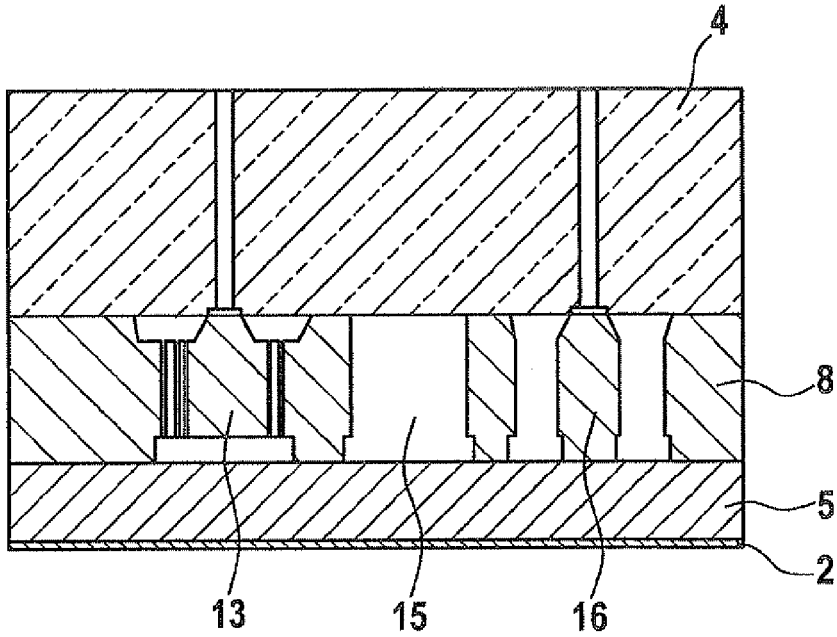
FIG. 14 shows essential method steps during the manufacturing of a micropump, the first carrier layer being part of the SOI wafer here, the method step according to FIG. 14 corresponding to the method step according to FIG. 11.

FIG. 14 shows the bonded wafer stack after the removal of first carrier layer 1. Because there are no contact holes in lower stop layer 2 in the SOI structure, the removal of first carrier layer 1 is possible particularly readily and easily by backetching in plasma. It is advantageous to monitor the isotropic silicon etching via $SF_6$ plasma using an endpoint detection system (OES). This indicates when silicon is no longer etched and when lower stop layer 2 has been reached overall, lower stop layer 2 representing the etch stop for this etching process. Overetching may also be provided for security, in order to actually remove all silicon from lower stop layer 2 without residue and compensate for any inhomogeneities. Because the entire process may be performed isotropically, ablation rates are extremely high (typically 100 μm/minute or more) and the processing time is very short (only a few minutes). Alternatively, wet etching may also be performed, for example, in hot potassium hydroxide solution employing an etching mask as the front side protection.

Figure 15:
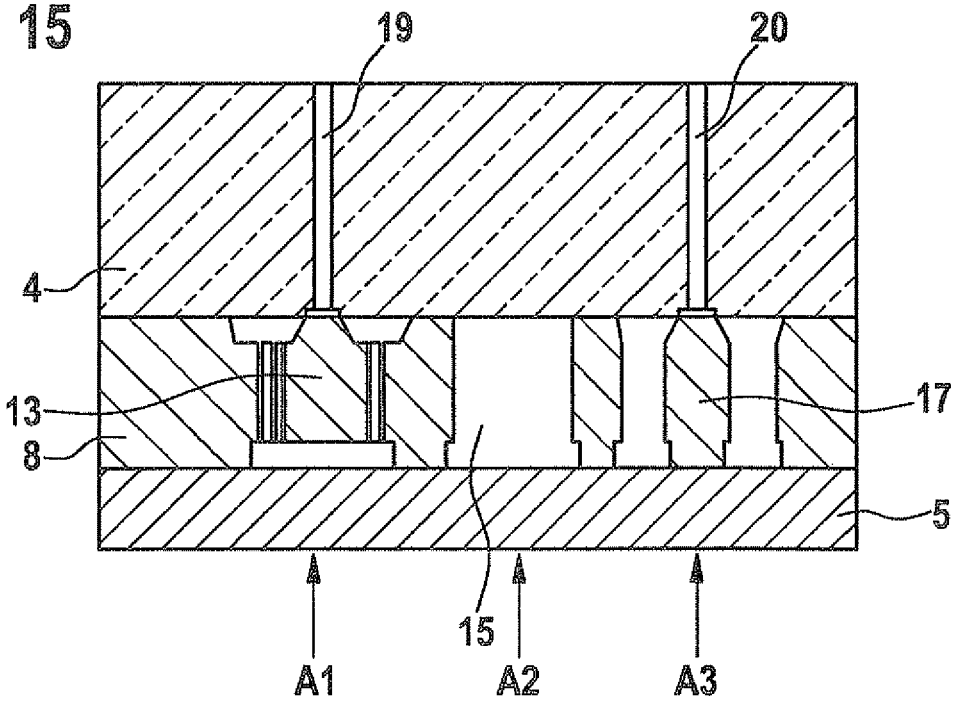
FIG. 15 shows essential method steps during the manufacturing of a micropump, the first carrier layer being part of the SOI wafer here, the method step according to FIG. 15 corresponding to the method step according to FIG. 12.

FIG. 15 shows the state of the wafer stack after the removal of lower stop layer 2 by liquid or vaporized hydrofluoric acid. Removing all oxide also suggests itself in this case, in order to remove undesired compression stresses from the mechanical structure. The function of actuators A1 through A3 shown is explained in the general part of the description.

In summary, a manufacturing process is proposed in the figures, which is exclusively based on standard processing steps of microsystem technology or semiconductor technology in both variants shown (silicon wafer/SOI wafer). Fragile wafer states or wafer intermediate states do not occur at any point in time of the process, in which the wafer or the wafer structure must be stabilized by films or similar complex special measures. Rather, robust structures are dealt with in all process stages, which may be handled and processed without special measures. All channels through which liquids are to flow during operation of the micropump have comparatively great channel heights of 15 μm to 24 μm, for example, and low flow resistances and small "dead volumes" as a result thereof. This is all implemented using a comparatively simple and particularly cost-effective process.

What is claimed is:

1. A method for manufacturing a micropump, the method comprising:

providing multiple layers on a front side of a first carrier layer, which has a front side and a rear side; and forming microfluidic functional elements by structuring at least one of the layers, wherein the structuring of the at least one layer for manufacturing all microfluidic functional elements is exclusively performed by front side structuring.

2. The method of claim 1, wherein a second carrier layer is situated at a distance to the first carrier layer.

3. The method of claim 2, wherein the second carrier layer has at least one fluid channel before or after it is installed.

4. The method of claim 3, wherein the first carrier layer is removed after the second carrier layer is installed, by at least one of isotropic etching, back grinding, and wet etching.

5. The method of claim 1, wherein the first carrier layer remains unstructured during the front side structuring.

6. The method of claim 1, wherein a silicon layer, which is a silicon wafer, is used as the first carrier layer.

7. The method of claim 1, wherein a stop layer, which contains silicon oxide, which is a thermal oxide layer, is situated directly on the front side of the first carrier layer, or the carrier layer is a component of an SOI wafer structure having an integral stop layer.

8. The method of claim 7, wherein the stop layer is provided with at least one contact hole for producing electrical connections between the first carrier layer and layers situated on the front side of the first carrier layer.

9. The method of claim 7, wherein a base layer, containing silicon, is situated directly on the front side of the stop layer, or the base layer is an integral component of the SOI wafer.

10. The method of claim 9, wherein a stop layer, which contains a silicon oxide, and is configured as a sacrificial layer, is situated and structured directly on the front side of the base layer.

11. The method of claim 10, wherein a functional layer, which is formed as an epi-polysilicon layer, is situated on the front side of the stop layer situated on the base layer and on the front side of the base layer.

12. The method of claim 11, wherein at least one depression is introduced into the functional layer in an area which is not to come into contact with the second carrier layer.

13. The method of claim 11, wherein at least one anti-bond layer is situated on the front side of the functional layer as at least one of a valve sealing surface and at least one anti-bond layer is situated on the rear side of the second carrier layer as a valve seat surface.

14. The method of claim 11, wherein at least one of an intake valve structure, a pump chamber structure, and an outlet valve structure is introduced by structuring the functional layer.

15. The method of claim 14, wherein at least one of the intake valve structure and the outlet valve structure are produced having at least one coiled spring section.

16. The method of claim 14, wherein the stop layer, which is configured as a sacrificial layer, is removed at least partially on the front side of the base layer, using at least one of liquid hydrofluoric acid and vaporized hydrofluoric acid.

17. A micropump, comprising:

multiple layers on a front side of a first carrier layer, which has a front side and a rear side; and microfluidic functional elements, which are formed by structuring at least one of the layers, wherein the structuring of the at least one layer for manufacturing all microfluidic functional elements is exclusively performed by structuring from one direction.

18. The micropump of claim 17, wherein the micropump has:

a carrier layer, which is a borosilicate glass layer, into which at least one fluid channel, which includes at least one of an intake channel and an outlet channel, is introduced; and a functional layer, with at least one of an intake valve, a pump chamber, and an outlet valve being introduced by structuring the functional layer.

19. The micropump of claim 18, wherein the intake valve of the micropump has at least one coiled spring carrying a valve plunger.

20. The micropump of claim 18, wherein at least one of the intake valve and the outlet valve of the micropump can be actively sealed using at least one actuator.

21. The micropump of claim 20, wherein at least one of a valve sealing surface of the intake valve and a valve sealing surface of the outlet valve can be pressed against the carrier layer using an actuator.

22. The micropump of claim 18, wherein at least one actuator is directly assigned to each of the intake valve, the outlet valve, and the pump chamber.

23. The micropump of claim 18, wherein at least one actuator is directly assigned to only the intake valve and the outlet valve, and the pumping action is controllable by triggering at least one of these actuators.

24. The micropump of claim 17, wherein the micropump is for providing a metered delivery of insulin.

25. The micropump of claim 17, wherein the micropump has a carrier layer, which is a borosilicate glass layer, into which at least one fluid channel, which includes at least one of an intake channel and an outlet channel, is introduced, and which directly delimits the pump chamber.

26. The micropump of claim 18, wherein the intake valve of the micropump has at least one coiled spring carrying a valve plunger, having multiple nested coiled springs.

27. The micropump of claim 18, wherein at least one actuator, which is a piezoactuator, is directly assigned to each of the intake valve, the outlet valve, and the pump chamber.

28. The method of claim 1, wherein a second carrier layer, which is a borosilicate glass wafer, is situated, by being anodically bonded, at a distance to the first carrier layer, and on the front side of the layer furthest away from the first carrier layer.

29. The method of claim 28, wherein the second carrier layer has at least one fluid channel, with an inflow channel and an outflow channel, before or after it is installed.

30. The method of claim 11, wherein at least one depression is introduced into the functional layer in an area which is not to come into contact with the second carrier layer, which is to be situated on the front side of the functional layer.

31. The method of claim 11, wherein at least one of an intake valve structure, a pump chamber structure, and an outlet valve structure is introduced by structuring the functional layer, by trench etching.

32. The method of claim 14, wherein at least one of the intake valve structure and the outlet valve structure are produced having at least one coiled spring section, having multiple nested coiled spring sections.

33. The method of claim 1, wherein the micropump is for providing a metered delivery of insulin.

34. The method of claim 11, wherein the microfluidic functional elements include an intake valve structure including a valve plunger and a plurality of nested coil springs, the plurality of next coils springs attached at ends to a plurality of uniformly distributed locations of a circumference of the valve plunger.

35. The micropump of claim 17, wherein the microfluidic functional elements include an intake valve structure including a valve plunger and a plurality of nested coil springs, the plurality of next coils springs attached at ends to a plurality of uniformly distributed locations of a circumference of the valve plunger.

36. The method of claim 2, wherein a functional layer is formed as an epi-polysilicon layer on the front side of a base layer.

37. The method of claim 36, wherein at least one depression is introduced into the functional layer in an area which is not to come into contact with the second carrier layer.

38. The method of claim 36, wherein at least one of an intake valve structure, a pump chamber structure, and an outlet valve structure is introduced by structuring the functional layer.

39. The method of claim 38, wherein at least one of the intake valve structure and the outlet valve structure are produced having at least one coiled spring section.

40. The method of claim 36, wherein at least one depression is introduced into the functional layer in an area which is not to come into contact with the second carrier layer, which is to be situated on the front side of the functional layer.

41. The method of claim 36, wherein at least one of an intake valve structure, a pump chamber structure, and an outlet valve structure is introduced by structuring the functional layer, by trench etching.

42. The method of claim 38, wherein at least one of the intake valve structure and the outlet valve structure are produced having at least one coiled spring section, having multiple nested coiled spring sections.

* * * * *

UNITED STATES PATENT AND TRADEMARK OFFICE

CERTIFICATE OF CORRECTION

PATENT NO. : 8,607,450 B2
APPLICATION NO. : 12/811936
DATED : December 17, 2013
INVENTOR(S) : Cassemeyer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 526 days.

Signed and Sealed this
Twenty-second Day of September, 2015

Michelle K. Lee

Michelle K. Lee
*Director of the United States Patent and Trademark Office*